US005786580A

United States Patent [19]

Yeo

[11] Patent Number: 5,786,580

[45] Date of Patent: Jul. 28, 1998

[54] PACKAGING HOLDER FOR POSITIONING AND PROTECTING MICROWAVE OVEN INTERNAL ELEMENTS SUCH AS A GLASS TRAY AND A ROTATING RING WITHIN AN OVEN CAVITY FOR HANDLING AND SHIPPING

[75] Inventor: Tae-Hong Yeo, Gyeongnam, Rep. of Korea

[73] Assignee: LG Electronics Inc., Seoul, Rep. of Korea

[21] Appl. No.: 752,927

[22] Filed: Nov. 20, 1996

[30] Foreign Application Priority Data

Dec. 11, 1995 [KR] Rep. of Korea ..... 48317/1995
Dec. 12, 1995 [KR] Rep. of Korea ..... 48728/1995

[51] Int. Cl.[6] ..... H05B 6/78; B65D 85/48; B65D 81/02

[52] U.S. Cl. ..... 219/752; 219/762; 206/583

[58] Field of Search ..... 219/732, 733, 219/753, 752, 762, 763; 99/DIG. 14; 426/234, 241, 243; 206/583

[56] References Cited

U.S. PATENT DOCUMENTS

| | | | |
|---|---|---|---|
| 3,427,422 | 2/1969 | Muller | 219/753 |
| 3,752,301 | 8/1973 | Bluemel | 206/583 |
| 4,033,009 | 7/1977 | Hoinash | 219/732 |
| 4,659,890 | 4/1987 | Viet | 219/753 |
| 4,698,472 | 10/1987 | Cox et al. | 219/732 |
| 4,965,424 | 10/1990 | Bagley | 219/732 |
| 5,232,095 | 8/1993 | Childers et al. | 206/583 |
| 5,493,103 | 2/1996 | Kuhn | 219/732 |

*Primary Examiner*—Philip H. Leung
*Attorney, Agent, or Firm*—Calfee, Halter & Griswold LLP

[57] ABSTRACT

A packaging holder for protecting and positioning internal elements, such as a glass tray and a rotating ring in the cooking cavity, of a packaged microwave oven is disclosed. The holder has a side holder part, a bottom seat part and a retaining flap part. In the holder, the diametrically-opposite side portions of the glass tray are inserted in and held by the side holder part. The bottom of the tray is held on the bottom seat part, while the top of the tray is covered with the retaining flap part. The rollers of the rotating ring are held by the roller holding notches of the retaining flap parts. The above holder is diagonally placed inside the oven's cavity in a way such that the holder is brought into close contact with the diagonally-opposite corners of the oven's cavity. The holder is made of a corrugated cardboard, so that the holder can be recycled while not causing environmental pollution.

13 Claims, 3 Drawing Sheets

PACKAGING HOLDER FOR POSITIONING AND PROTECTING MICROWAVE OVEN INTERNAL ELEMENTS SUCH AS A GLASS TRAY AND A ROTATING RING WITHIN AN OVEN CAVITY FOR HANDLING AND SHIPPING

BACKGROUND OF THE INVENTION

1. Field of the Invention

The present invention relates, in general, to a holder for the internal elements of microwave ovens which are securely packaged for shipping and handling and, more particularly, to an improvement in such a holder for simplifying the construction of the holder, stably holding the oven's internal elements in their positions inside an oven's cavity, and allowing the holder to be easily recycled thereby effectively preventing the holder from causing environmental pollution.

2. Description of the Prior Art

In a process for producing and transporting microwave ovens, the microwave ovens must be packaged prior to transporting them. That is, the microwave ovens are tightly packaged in respective boxes. Each typical microwave oven has a cubic configuration, so that the box for packaging the oven has a cubic configuration corresponding to the oven and has a size of being almost equal to that of the oven. While the ovens are packaged in the boxes, the internal elements of each oven, such as the glass tray and rotating ring, are preferably held in their places inside the cavity of the packaged oven, thus saving the internal space of the box and thereby achieving the recent trend of compactness of the packaged oven.

While a packaged oven is handled during transportation, the packaged oven may be carelessly impacted or vibrated, so that the oven's internal elements such as the glass tray and rotating ring may move inside the oven's cavity, thus causing a scratch or damage of the cavity walls of the oven. In this regard, the above internal elements must be stably held in their positions inside the cavity of the packaged oven. In order to achieve the above object, the internal elements positioned inside the oven's cavity are held by a holder, which not only holds the internal elements but also absorbs and intercepts an external shock, thereby preventing the internal elements from moving inside the oven's cavity and from damaging the cavity wall.

FIGS. 1A and 1B show the construction of a typical holder used for holding the internal elements inside the cavity of a packaged microwave oven. As shown in FIGS. 1A and 1B, the holder comprises a packing table 2 and a retainer 3. The packing table 2 is placed in the lower space inside the cavity 1*a* of the oven 1, while the retainer 3 is placed above the packing table 2. The retainer 3 in the above state is tightly fitted between the top of the table 2 and the top wall of the oven's cavity 1*a*. The retainer 3 cooperates with the table 2 in order to hold the internal elements in their places inside the cavity 1*a*.

The above packing table 2 has a cubic configuration and is sized enough to be prevented from horizontal moving inside the cavity 1*a* when it is placed inside the cavity 1*a*. A stepped circular depression is formed on the center of the top of the above packing table 2.

The above stepped depression is divided into two seats, that is, upper and lower seats having different diameters, by the step. The lower seat 2*a* of the stepped depression has a smaller diameter and receives the rotating ring 4, while the upper seat 2*b* of the stepped depression has a larger diameter and receives the glass tray 5. Therefore, the lower seat 2*a* forms a rotating ring seat, while the upper seat 2*b* forms a glass tray seat.

The packing table 2 is preferably made of styrofoam, while the retainer 3 is preferably made of a corrugated cardboard. The corrugated cardboard is bent in order to form the retainer 3 having a triangular cross-section.

In order to hold the internal elements of the oven using the above holder before the oven is packaged in a box, the rotating ring 4 is seated in the lower seat 2*a* of the packing table 2 and the glass tray 5 is seated in the upper seat 2*b* prior to placing the packing table 2 inside the cavity 1*a*. After the packing table 2 is placed inside the cavity 1*a*, the triangular retainer 3 is placed above the top of the table 2. In the above state, the retainer 3 is tightly fitted between the top wall of the cavity 1*a* and the top of the table 2. The triangular bottom edge of the retainer 3 is laid across the top of the stepped depression of the table 2, so that the retainer 3 retains both the rotating ring 4 and the glass tray 5 in their seats 2*a* and 2*b* of the stepped depression of the table 2.

However, the above holder has a complex construction, so that the holder wastes labor, reduces work efficiency and takes too long while the microwave ovens are packaged. Another problem of the above holder is caused by the material of the packing table 2. That is, the styrofoam packing table 2 cannot be recycled, thus causing environmental pollution.

SUMMARY OF THE INVENTION

It is, therefore, an object of the present invention to provide a holder for the internal elements of a packaged microwave oven in which the above problems can be overcome and which has a simple construction, stably holds the oven's internal elements in their positions inside the oven's cavity and is effectively recycled while not causing any environmental pollution.

In order to accomplish the above object, an embodiment of the present invention provides a packaging holder for the internal elements, such as a glass tray and a rotating ring, of a packaged microwave oven. The above holder has a length which is nearly equal to the diagonal length of the cavity. The holder is brought into close contact with the diagonally-opposite corners of the oven's cavity, thereby being prevented from moving inside the cavity. The holder comprises two side holder parts which tightly receive and hold the diametrically-opposite side portions of the glass tray. Each of the side holder parts is provided with a slot for receiving and holding the diametrically-opposite side portions of the glass tray. A bottom seat part extends inward from the bottoms of the side holder parts and hold the bottom of the glass tray. The above holder also includes two retaining flap parts which cover the top of the glass tray seated on the bottom seat part.

In the holder which is diagonally placed inside the oven's cavity, the diametrically-opposite side portions of the glass tray are inserted in and held by the slots of the side holder parts, respectively. The bottom of the tray in the above state is held on the bottom seat part, while the top of the tray is covered with the retaining flap parts, so that the tray is stably held by the holder.

In addition, the rotating ring of the oven is held by the above holder. In this case, the rotating ring is seated above the glass tray inside the holder while holding the rollers of the rotating ring in the roller holding notches which are formed on the upper flaps of the retaining flap parts.

The above holder is preferably made of a corrugated cardboard which can be recycled while not causing environmental pollution. In order to form the holder, a plurality of bending lines and cutting lines are formed on a rectangular corrugated cardboard in accordance with the specifically-designed configuration of the holder. Thereafter, the cardboard is bent along the bending lines in order to form the holder.

BRIEF DESCRIPTION OF THE DRAWINGS

The above and other objects, features and other advantages of the present invention will be more clearly understood from the following detailed description taken in conjunction with the accompanying drawings, in which:

FIGS. 1A and 1B are views showing the construction of a typical prior art holder used for holding the internal elements inside the cavity of a packaged microwave oven, in which:

FIG. 1A is a perspective view showing the holder placed inside the oven's cavity; and FIG. 1B is an exploded perspective view showing the construction of the holder and the oven's internal elements to be held by the holder;

DESCRIPTION OF THE PREFERRED EMBODIMENTS

FIGS. 2 to 5 show the configuration, construction and operational effect of the holder in accordance with the primary embodiment of this invention. As shown in FIGS. 1 to 5, the holder 6 has a single structure of a symmetric configuration and includes a bottom seat part, two retaining flap parts and two side holder parts. The above bottom seat part holds the bottom of the glass tray 4, while the retaining flap parts cover the top of the glass tray 4 seated on the above bottom seat part. Meanwhile, the side holder parts receive the diametrically-opposite side portions of the tray 4 thus holding the tray 4.

The above bottom seat part comprises two outside seats 6*b* and an inside seat 6*a*. Each of the outside seats 6*b* also forms the bottom of each of the above side holder parts and holds a side bottom portion of the glass tray 4. Meanwhile, the inside seat 6*a* comprises two semicircular members, which extend inward from the respective outside seats 6*b* and are connected together by a center rib. The above inside seat 6*a* holds the bottom center portion of the tray 4.

The retaining flap parts are provided on both sides of the above bottom seat part. Each of the retaining flap parts comprises a lower retaining flap 6*f'* and an upper retaining flap 6*f*. The upper flap 6*f* is bent in order to cover the top of the lower flap 6*f'*. The free edge of the upper flap 6*f* is provided with a roller holding notch 6*e*. The above notch 6*e* holds one roller 5*a* of a rotating ring 5, thus holding the rotating ring 5.

The side holder parts, which receive the diametrically-opposite side portions of the tray 4 thus holding the tray 4, are provided on both sides of the above bottom seat part. As described above, the outside seats 6*b* of the bottom seat part form the bottoms of the side holder parts. Each of the side holder part also has two side walls, that is, inner and outer side walls 6*d* and 6*d'* which extend upward from both sides of each outside seat 6*b*, respectively. The center of the inner side wall 6*d* is provided with a slot 6*c* which receives one side portion of the tray 4 in order to hold the tray 4. The outer side wall 6*d* forms the side wall of the holder.

The holder 6 of this invention is preferably formed of a corrugated cardboard. A method for forming the holder 6 using a corrugated cardboard is shown in FIGS. 3 and 4.

Figure 3:
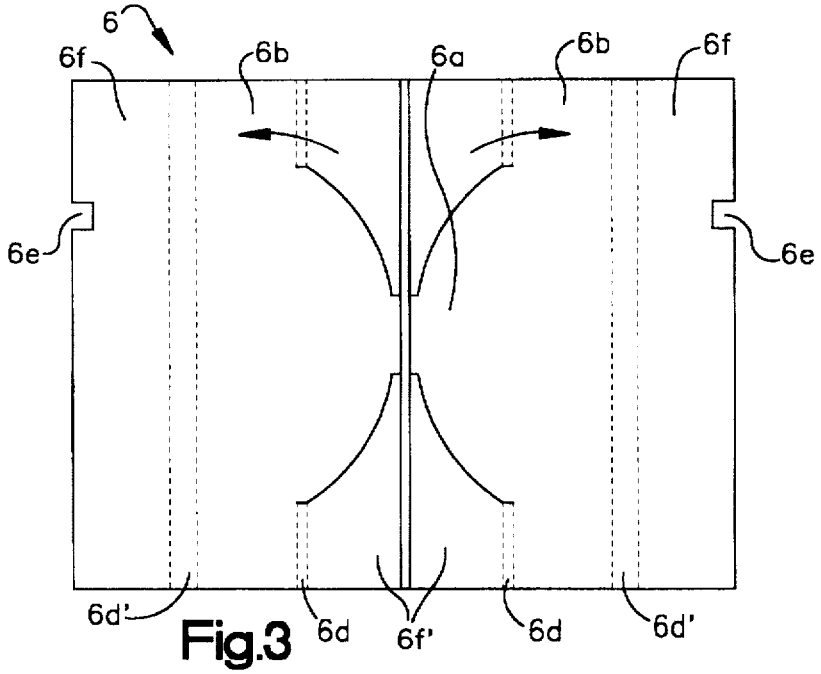
FIG. 3 is a development view of the holder of FIG. 2.
Figure 4:
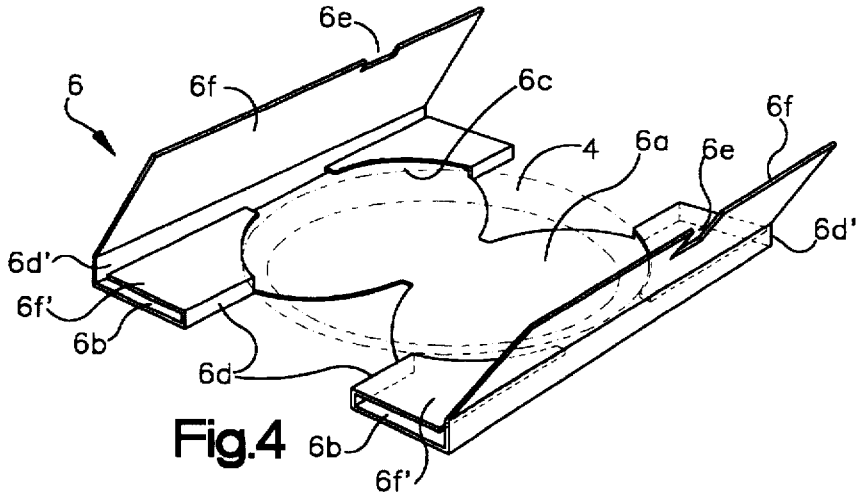
FIG. 4 is a perspective view showing the holder of FIG. 2, when the developed board of FIG. 3 is bent into the holder.

FIG. 3 shows a developed board of the packaging holder 6 of this invention. As shown in FIG. 3, an upper retaining flap 6*f*, which is provided with a roller holding notch 6*e*, is formed by making a first bending line on each side portion of the rectangular corrugated board. Thereafter, a second bending line is formed on the board at a position, which is spaced apart from and is parallel to the first bending line, thus forming an outer side wall 6*d'* having a predetermined width. The middle portion of the above board is linearly and roundly cut out in accordance with the specifically-designed configurations of both the inside seat 6*a* and the lower retaining flaps 6*f'*, thus forming the seat 6*a* and flaps 6*f'* on the board. Third and fourth holding lines, which are spaced apart from and are parallel to each other, are formed on each side portion of the board in order to form both an outside seat 6*b* and an inner side wall 6*d*.

In FIG. 3, the dotted lines denote the bending lines, while the solid lines denote the cutting lines. After the cutting and bending lines are completely formed on the board, the board is bent along the bending lines as shown in FIG. 4, thus forming the holder 6. In order to hold the oven's internal elements by the above holder 6, the glass tray 4 is primarily seated on the bottom seat part of the developed board of FIG. 3. Thereafter, the board is bent along the third and fourth bending lines, thus forming the inner side walls 6*d* and the lower retaining flaps 6*f'*. In this case, the holding slots 6*c*, which allow the diametrically-opposite side portions of the tray 4 to reach the interiors of the side holder parts of the holder 6, are formed on the center portions of the respective inner side walls 6*d*.

Thereafter, the board is bent along the first and second bending lines, thereby forming the outer side walls 6*d'* and the upper retaining flaps 6*f*. In the above case, each upper flap 6*f* is bent in order to cover the top of an associated lower flap 6*f'*, so that the diametrically-opposite side portions of the tray 4 are covered with the upper flaps 6*f*.

Figure 1A:
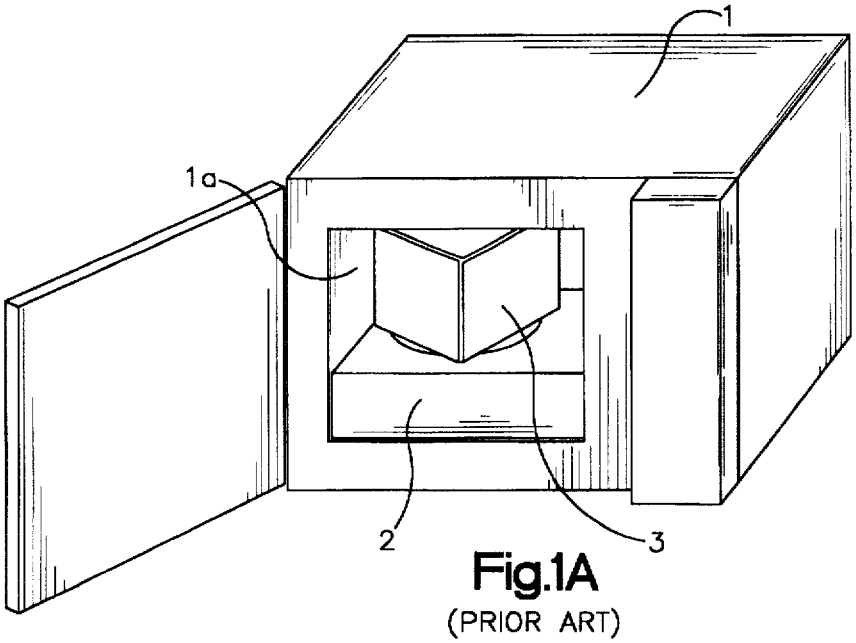
Fig.1A (PRIOR ART)
Figure 1B:
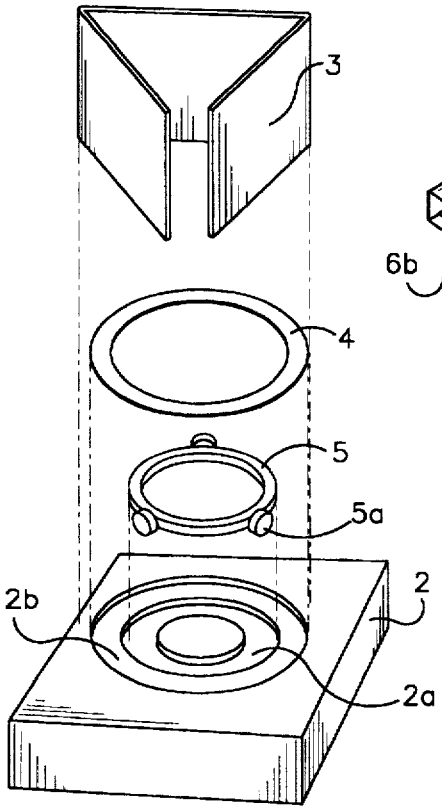
Fig.1B (PRIOR ART)
Figure 2:
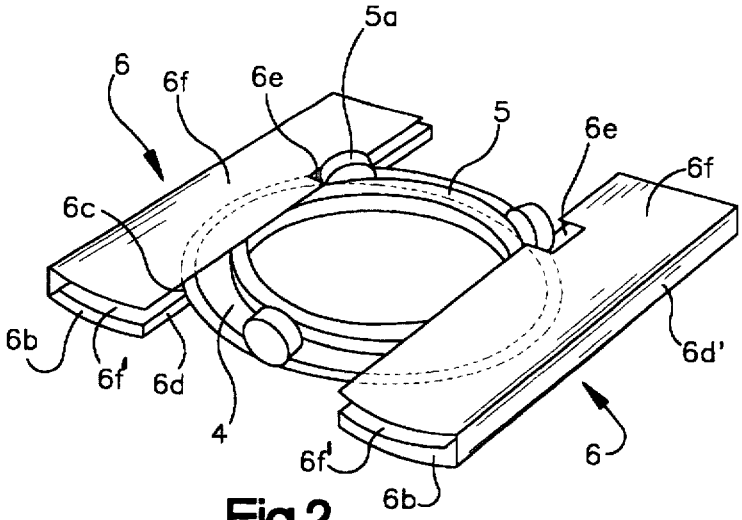
FIG. 2 is a perspective view showing the configuration and construction of the holder in accordance with the primary embodiment of the present invention.

The rollers 5*a* of a rotating ring 5 as shown in FIG. 2 are inserted into the roller holding notches 6*e*of the upper flaps 6*f*, so that the rotating ring 5 is held by the holder 6.

Figure 5:
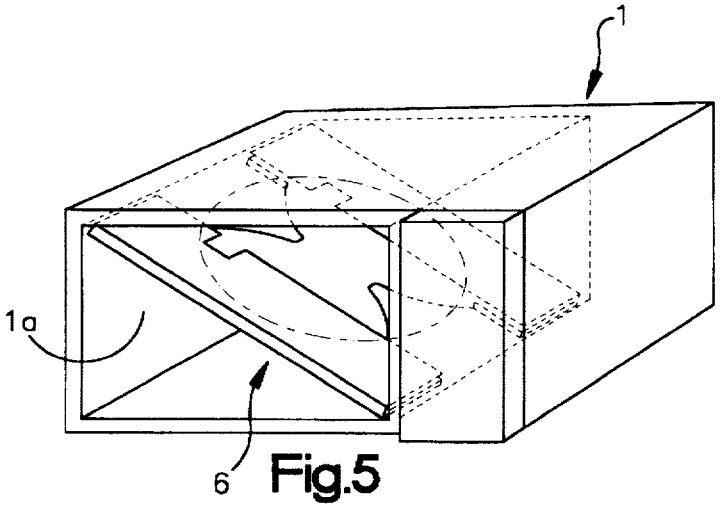
FIG. 5 is a perspective view showing the holder of FIG. 2, which holds the internal elements and is placed inside the cavity of a microwave oven.

The holder 6, which holds both the glass tray 4 and the rotating ring 5 therein, is diagonally seated in the oven's cavity 1*a* as shown in FIG. 5, thus stably holding the internal elements inside the cavity 1*a* prior to packaging the oven 1 in a box.

Figure 6:
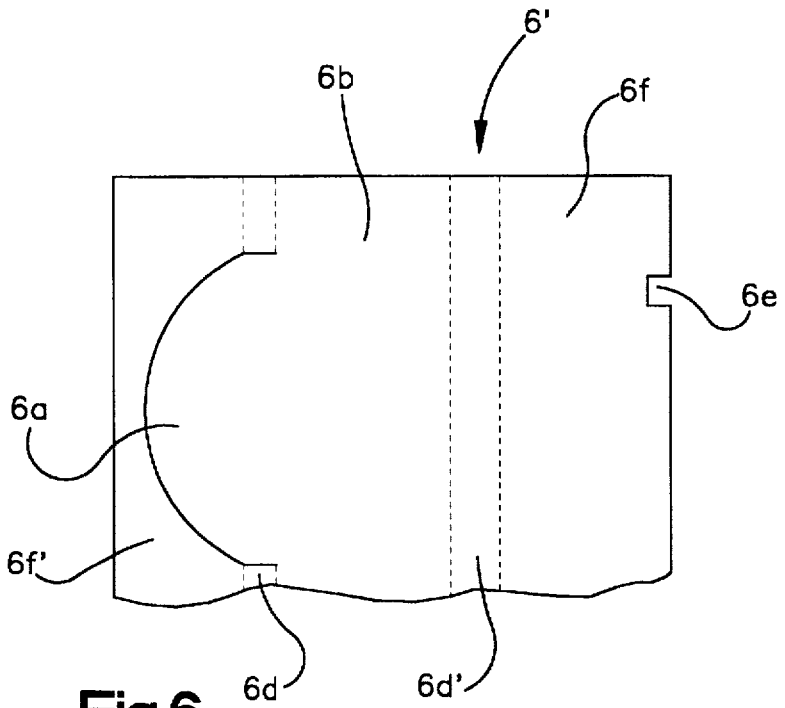
FIG. 6 is a development view of the holder in accordance with another embodiment of the present invention.
Figure 7:
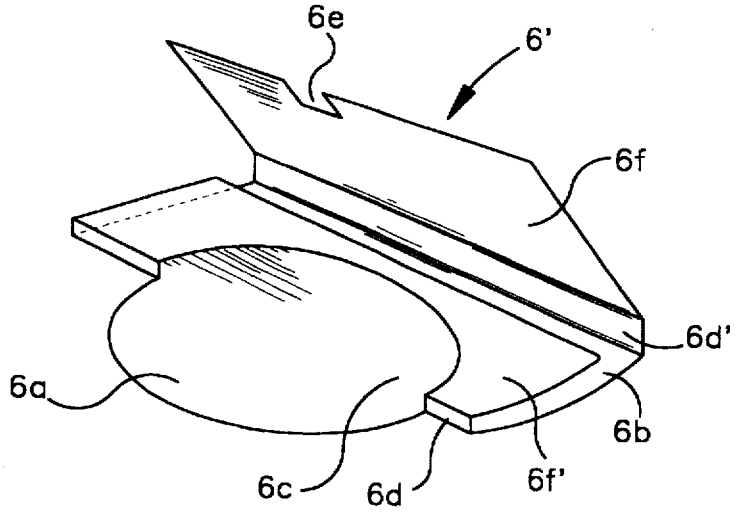
FIG. 7 is a perspective view showing the holder of FIG. 6, when the developed board of FIG. 6 is bent into the holder.

FIGS. 6 and 7 show the holder in accordance with a second embodiment of the present invention. In this second embodiment, the configuration and construction of the holder 6' are equal to those of one side part of the symmetric holder 6 of the primary embodiment.

That is, different from the holder 6 of the primary embodiment, which has the inside seat 6*a* comprising the two semicircular members connected together by a rib into a symmetrical configuration, the holder 6' of the second embodiment has an inside seat 6*a*, which extends from an outside seat 6*b* and has an arcuate edge.

In addition, either side edge of each of the upper flap 6*f*, lower flap 6*f'* and outside seat 6*b* are smoothly curved in order to allow the holder 6 to be smoothly inserted into the oven's cavity 1*a*. In the above case, the curved edges of the upper flap 6*f*, lower flap 6*f'* and outside seat 6*b* preferably have the same radius of curvature.

In order to hold the oven's internal elements such as a glass tray and rotating ring, using two holders 6' prior to packaging the oven 1 in a box, a first holder 6' is fully inserted into the oven's cavity 1*a* thereby being diagonally seated in the rear portion inside the cavity 1*a*. Thereafter, a second holder 6' is fitted over one side portion of the glass tray 4. In this case, the side portion of the tray 4 is fully inserted into the slot 6*c* of the second holder 6'. In addition, one roller 5*a* of the rotating ring 5 is inserted into the roller holding notch 6*e* of the second holder 6'. The second holder 6', holding both the tray 4 and the rotating ring 5, is diagonally inserted into the cavity 1*a* in order to insert the other side portion of the tray 4 into the slot 6*c* of the first holder 6' at the same time of inserting another roller 5*a* of the rotating ring 5 into the slot 6*c* of the first holder 6'. Therefore, the tray 4 and rotating ring 5 are stably and tightly held by the two holders 6' inside the cavity 1*a*.

The operational effect of the holder of this invention will be described hereinbelow.

In the holders 6, 6' of this invention, the length of the holder is nearly equal to the diagonal length of the cavity 1*a*, so that the holder 6, 6' is brought into close contact with diagonally-opposite corners of the cavity 1*a*, thereby being prevented from moving inside the cavity 1*a*.

Inside the above holder 6, 6', the bottom of the glass tray 4 is tightly held by the bottom seat part of the holder, while the top of the tray 4 is covered with the upper flaps 6*f*. In addition, the diametrically-opposite side portions of the tray 4 are tightly inserted into the slots 6*c*, so that the tray 4 is stably seated in the side holder parts. The rollers 5*a* of the rotating ring 5 are inserted in the roller holding notches 6*e* of the upper flaps 6*f*, so that the rotating ring 5 is also stably and tightly held by the holder 6, 6'.

The holder 6, 6' of this invention thus stably holds the oven's internal elements (the glass tray 4 and rotating ring 5) inside the cavity 1*a* of a packaged microwave oven 1, so that the holder 6, 6' prevents the internal elements from moving inside the cavity 1*a* even when the packaged oven 1 is carelessly impacted or vibrated while the packaged oven 1 is handled during transportation of the oven 1.

As described above, the present invention provides a structurally-improved holder for the internal elements of a packaged microwave oven. The holder of this invention has a simple construction and stably holds the oven's internal elements in their positions inside the oven's cavity. The above holder can be recycled, so that the holder does not cause any environmental pollution.

Although the preferred embodiment of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A holder for packaging internal elements including a glass tray and a rotating ring of a microwave oven to position and protect the internal elements within the oven for shipment and handling, said holder adapted to be diagonally fitted inside a cavity of said oven, and comprising two opposed holding slots for tightly receiving and holding diametrically-opposite side portions of said glass tray, said holding slots formed by lower retaining flaps folded from a generally rectangular planar form toward outer side edges of the form, and by upper retaining flaps extending from the outer edges of the form folded inwardly and over the lower retaining flaps, and over a portion of a glass tray positioned between the lower retaining flaps.

2. The holder according to claim 1, wherein said holder has a bottom seat part adapted for holding the bottom of said glass tray, and the lower retaining flaps and the upper retaining flaps extend from the bottom seat.

3. The holder of claim 2 wherein the lower retaining flaps are connected to the bottom seat by inner side walls, and the upper retaining flaps are connected to the bottom seat by outer side walls.

4. The holder of claim 1 further comprising a notch in each of retaining flaps adapted to engage a portion of a rotating ring.

5. A packaging holder device for positioning and protecting a glass tray and rotating ring within a cavity of a microwave oven, the packaging holder device comprising:

a bottom seat part adapted for holding a glass tray;

two upper retaining flaps extending from the bottom seat and adapted to cover a portion of a glass tray on the bottom part; and two lower retaining flaps extending from the bottom seat and adapted to tightly receive and hold diametrically-opposite side portions of said glass tray.

6. The holder according to claim 5, wherein said side holder parts are provided on both sides of said bottom seat part, each of said side holder parts further comprising:

inner and outer side walls, the lower retaining flaps connected to the bottom seat by the inner side walls, and the upper retaining flaps connected to the bottom seat by the outer side walls, said inner side walls forming a holding slot for receiving a side portion of said glass tray in order to hold said tray, and said outer side wall forming a side wall of said holder.

7. The holder according to claim 5, wherein said bottom seat part comprises:

two outside seats adapted for holding diametrically-opposite side bottom portions of said glass tray; and an inside seat adapted for holding a bottom center portion of said tray.

8. The holder according to claim 7, wherein said inside seat comprises two semicircular members, said semicircular members extending inward from the respective outside seats and being connected together by a center rib.

9. The holder according to claim 5, wherein said holder is made of a corrugated cardboard.

10. A packaging holder device for positioning and protecting a glass tray in a cooking cavity of a microwave oven to protect the tray within the oven during shipping and handling, the packaging holder device comprising:

a symmetrical generally planar structure including a bottom seat configured to underlie a glass tray placed thereon;

lower retaining flaps connected to the bottom seat along fold lines which allow the lower retaining flaps to be folded toward outer edges of the bottom seat and about edges of a glass tray positioned on the bottom seat;

upper retaining flaps connected to the outer edges of the bottom seat along fold lines which allow the upper retaining flaps to be folded over the bottom seat, over the lower retaining flaps, and over opposite sections of a glass tray positioned on the bottom seat;

a width dimension of the device, measured from one outer edge of the bottom seat to an opposite outer edge, being approximately equal to a diagonal dimension of a microwave oven cavity measured from an upper corner to an opposite lower corner.

11. A packaging device for use in combination with a microwave oven and a tray which fits in a cooking cavity of the oven, the packaging device comprising:

a generally planar foldable structure having a central bottom seat dimensioned to underlie a tray placed thereon;

lower retaining flaps attached to the bottom seat and foldable outward toward side edges of the bottom seat to form slots for receiving opposite edges of the tray;

upper retaining flaps extending from side edges of the bottom area and foldable over the lower retaining flaps, and opposite edges of the tray, thereby retaining the tray within the slots and against the bottom seat;

a width of the bottom seat dimensioned to extend from an upper corner of an oven cooking cavity to an opposite lower corner, whereby the packaging device positions and protects the tray within the cavity.

12. The packaging device of claim 11 wherein the upper retaining flaps include a notch adapted to engage a portion of a rotating ring held within the upper and lower retaining flaps.

13. The packaging device of claim 11 wherein edges of the upper and lower retaining flaps are smoothly curved.

* * * * *